United States Patent [19]

Bush

[11] Patent Number: 4,673,368

[45] Date of Patent: Jun. 16, 1987

[54] TOY BANK WITH NOVEL COIN DISCRIMINATING MECHANISM

[75] Inventor: Vincent N. Bush, Madison Lake, Minn.

[73] Assignee: Playtronics Corporation, Mankato, Minn.

[21] Appl. No.: 887,076

[22] Filed: Jul. 17, 1986

[51] Int. Cl.[4] ..... A63H 33/30

[52] U.S. Cl. ..... 446/8; 194/334; 232/4 R; 232/7

[58] Field of Search ..... 446/8, 13; 232/4 R, 232/7, 14, 10, 57.5, 57; 194/334

[56] References Cited

U.S. PATENT DOCUMENTS

| | | | |
|---|---|---|---|
| 2,622,803 | 12/1952 | Farber | 446/8 X |
| 2,973,074 | 2/1961 | Haverstick | 194/334 X |
| 3,237,631 | 3/1966 | Kamei et al. | 194/334 X |
| 3,939,954 | 2/1976 | Collins | 194/334 X |

*Primary Examiner*—Philip C. Kannan
*Attorney, Agent, or Firm*—Gregory P. Kaihoi

[57] ABSTRACT

A toy bank having a coin discriminating mechanism for discriminating between coins of varying diameters. The mechanism includes a housing having a coin slot, the slot having two generally flat, spaced walls and two relatively narrow spaced sides, the sides defining the breadth of a coin passageway. A movable slide is disposed within the passageway and normally biased toward a resting position at least partially obstructing the breadth of the passageway. The slide is movable in response to insertion of a coin. Electronic circuitry is provided to detect movement of the slide and translate that movement into information relating to the denomination of the coin. Preferably the slide is movable in a direction not parallel to a line defined by a first point of contact between a coin and the slide, and a second point of contact between the coin and the first side of the passageway, said points of contact being identified when the slide is maximally displaced by the coin. In this configuration, the differences in displacement of the slide upon insertion of coins of varying diameters will be larger than the differences in the diameters of the respective coins.

13 Claims, 7 Drawing Figures

11
10
12

TOY BANK WITH NOVEL COIN DISCRIMINATING MECHANISM

FIELD OF THE INVENTION

The invention relates to a toy electronic bank, and more particularly to a toy electronic bank having a novel coin discriminating mechanism.

BACKGROUND OF THE INVENTION

Conventional toy coin banks have typically included only a container in some aesthetically pleasing shape having a slot therein to receive coins of various diameters. Unless one keeps a written record of coins deposited, however, it is often difficult or impossible to know at any given time the total amount contained by the bank. Recent attempts to solve this problem have involved the combination of conventional calculator electronics with a traditional toy bank. In such products, the operator places a coin in the bank and then enters the amount deposited through a conventional ten button key pad, the amount being stored by conventional calculator electronics. Such products do not automatically recognize coin denomination.

Various types of vending machines have included rather complicated electro-mechanical devices for recognizing and discriminating coin sizes and automatically tabulating the amount deposited. Such devices tend to be bulky, complicated, and relatively expensive, particularly so relative to applications for toy banks and the like. Also, such devices often consume a significant amount of electricity in their operation, particularly in comparison to a toy bank which desirably will operate on small batteries for an extended period of time—preferably a year or more.

SUMMARY OF THE INVENTION

The present invention relates to an electronic toy bank having a coin discriminating apparatus which has few moving parts, is simple and economical to manufacture, consumes very little power, and is accurate. The coin discriminating apparatus includes a housing having coin slot means in a surface thereof for receiving therein a coin inserted into the housing. The slot means includes two generally flat, spaced walls defining therebetween the width of a coin passageway, and two relatively narrow, spaced sides defining therebetween the breadth of the passageway. The apparatus further includes a movable slide disposed within the passageway, the slide being normally biased toward a resting position at least partially obstructing the breadth of the passageway and being movable in response to insertion of a coin. Detection means is provided, operatively connected to the slide, for detecting movement of the slide so that when a coin is inserted into the passageway between the slide and a first of said sides, the slide is displaced a distance related to the coin's size, which displacement is detected by the detection means and related to the coin's size.

Preferably, the slide is movable in a direction not parallel to a line defined by a first point of contact between a coin and the slide, and a second point of contact between the coin and said first side of the passageway, said points of contact being identified when the slide is maximally displaced by the coin. In this configuration the differences in displacement of the slide upon insertion of coins of varying diameters will be larger than the differences in the diameters of the respective coins.

In a preferred embodiment, the detection means includes a wiper switch mechanism comprising a contact surface and a movable wiper contact mechanically linked to the slide and in electrically conductive contact with the contact surface. The contact surface includes a plurality of conductive segments, each corresponding to a particular coin size. As the slide is displaced by a coin of a given size, the wiper contact moves across the contact surface into electrically conductive contact with a segment corresponding to the size of the coin inserted.

To provide a "snap action" to mechanically thrust the coin inwardly, preferably the breadth of the passageway increases immediately inwardly of said first line. Such an increase in breadth can be realized by a variety of configurations. Preferably that portion of the first side of the passageway inward of said second point recedes from a second line which contains said second point and is perpendicular to said first line. Alternately or in combination therewith, desirably that portion of the slide inward of said first point recedes from a third line which contains said first point and is perpendicular to said first line.

DETAILED DESCRIPTION OF THE INVENTION

The diameters of United States coins are all different, and, therefore, may be used to electromechanically differentiate the coins. Diameters are as follows:

| Denomination | Diameter |
|---|---|
| Penny | 19.0 mm |
| Dime | 17.9 mm |
| Nickel | 21.2 mm |
| Quarter | 24.3 mm |
| Half Dollar | 30.6 mm |

The above chart indicates that the penny and dime are only 1.1 mm different in diameter. The smallness of this difference defines the precision with which any mechanism must "measure" the diameter of a coin.

Figure 1:
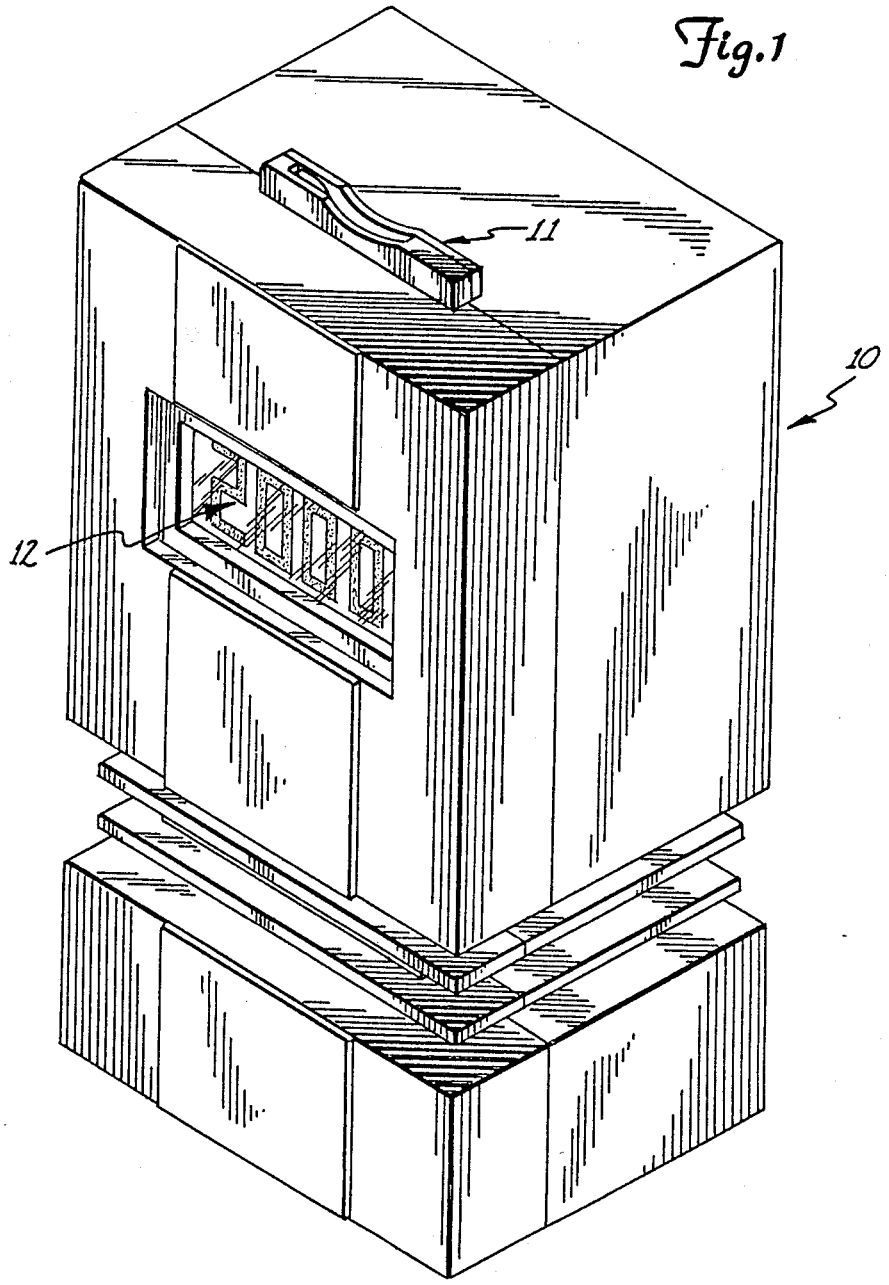
FIG. 1 is a perspective view of a toy bank of the invention.
Figure 2:
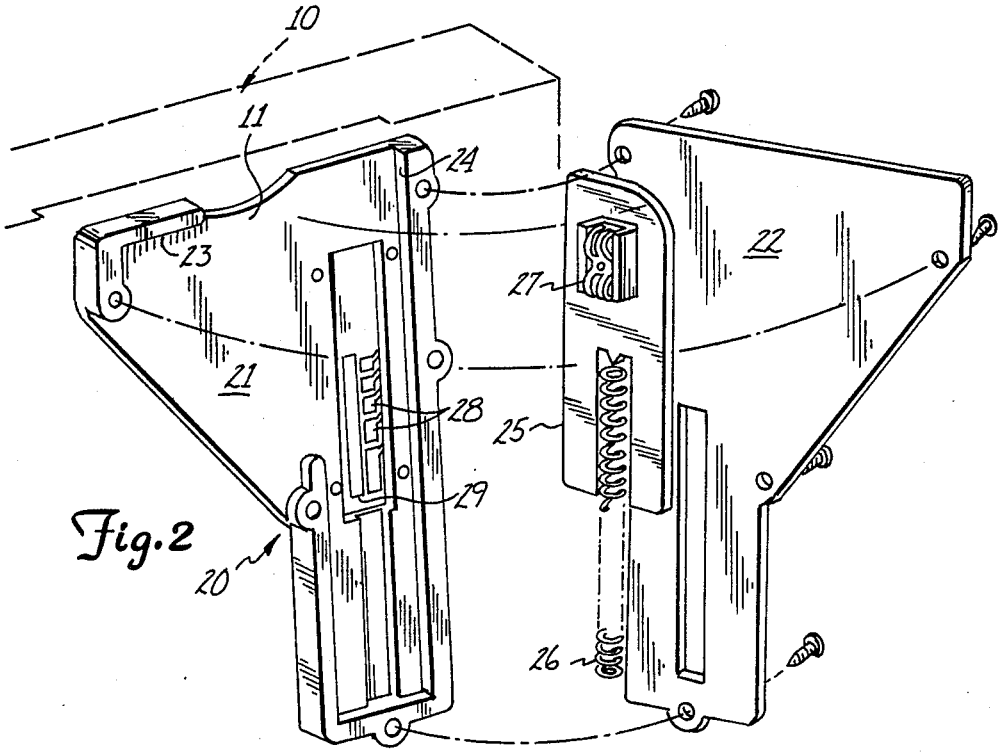
FIG. 2 is an exploded, partially broken away view of the a coin discriminating apparatus of the invention.

In FIG. 1, a toy bank according to the invention has a housing 10 with a slot 11 therein for receiving coins. An electronic display 12 is provided for displaying information such as the denomination of a coin which has been inserted, the cumulative total of coins inserted, or other matters such as the time of day, month and day, etc. FIG. 2 shows in exploded fashion the details of a preferred embodiment of the invention. The slot 11 includes two generally flat, spaced walls 21 and 22 defining the width of a coin passageway (the width being the distance separating said walls 21 and 22). The breadth of the slot passageway is defined by relatively narrow, spaced sides 23 and 24. Subject to the requirements described below, the walls and sides defining the passageway may be of any suitable configuration which maintains proper orientation of the coin as it passes through the discriminating mechanism 20.

A movable slide 25 is disposed at least partially within the passageway, and is normally biased toward a resting position by a spring 26 or similar means. As a coin 40 is inserted into the slot 11, the slide 25 is displaced from its resting position. Detection means operatively connected to the slide 25 is provided for detecting such displacement and relating it to coin diameter. Although a variety of detection means would adequately perform this function, a preferred means includes a wiper switch mechanism which includes a contact surface and a wiper contact 27 which is carried by the slide 25.

Although the contact surface might comprise a surface of continuously variable electrical resistance to provide an analog signal corresponding to slide displacement, preferably the contact surface comprises a series of discreet segments 28 providing a digital signal. The embodiment of FIG. 2 shows two contact strips. One such strip includes a plurality of contact segments 28, each corresponding to a coin size. The other strip 29 is a common strip. A suitable resilient wiper contact 27 engages both strips, completing the electrical circuit from the common strip 29 to the various segments 28 as the contact 27 moves over them.

Conventional electronic logic circuitry is provided to interpret the signals generated by the wiper switch, relating such signals to coin size, and generating a corresponding signal to be displayed on the display 12. Such circuitry is well known and need not be described in detail.

Figure 3:
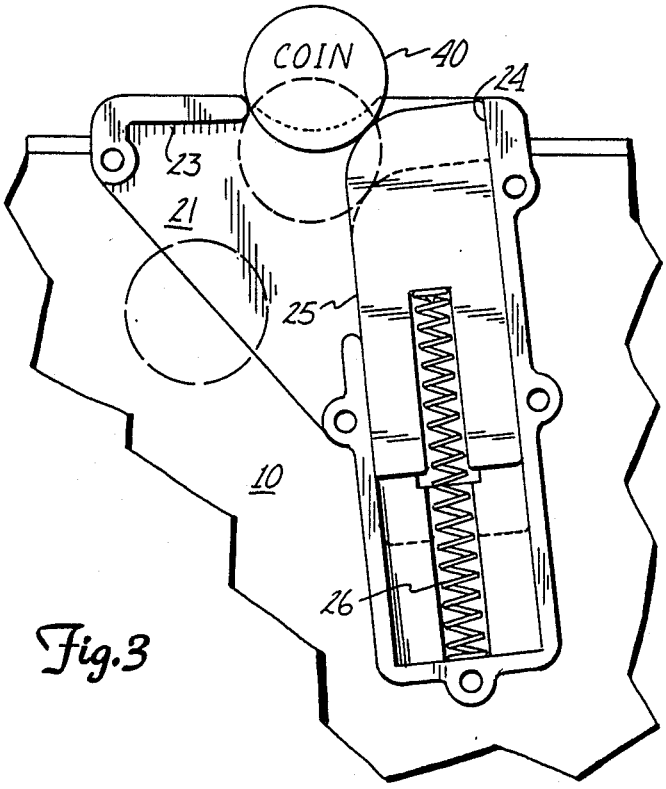
FIG. 3 is a partially broken away view of detail of a coin discriminating apparatus of the invention.
Figure 4:
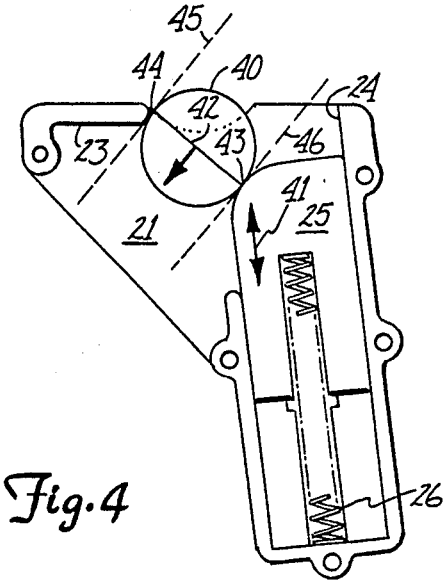
FIG. 4 is another broken away view of a coin discriminating apparatus of the invention.
Figure 5:
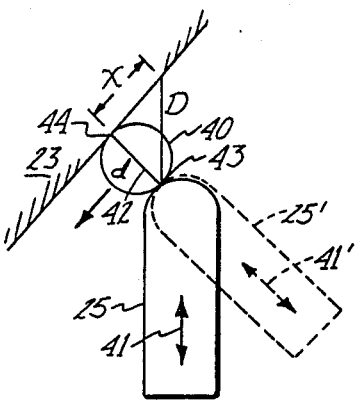
FIG. 5 is a schematic view of a coin discriminating apparatus of the invention.

FIGS. 3–5 depict in greater detail the passage of a coin through the slot passageway. The breadth of the passageway, measured from a first side 23 to the movable slide 25 must be narrower than the diameter of the smallest coin 40 to be discriminated. As shown in FIG. 3, as the coin 40 is inserted the slide 25 is displaced from it at rest position until it reaches maximum displacement shown in fantom lines in FIG. 3. FIG. 4 depicts the slide 25 at maximum displacement. In this position, the coin 40 is in point contact on one side with the slide 25, the point designated as 43, and also with the opposing side 23 of the passageway, said point being designated 44. The distance between points 43 and 44 is equal to the diameter of the coin 40. The points define a first line 42 which is perpendicular to the direction of travel of the coin 40.

As the coin 40 moves inward from the position shown in FIG. 4, the slide 25 begins to return to its at-rest position, exerting a "snap-action" force on the coin 40 to thrust it inwardly. To enhance this snap-action, the breadth of the passageway must increase immediately inwardly of the first line 42. Desirably, that portion of the first side 23 of the passageway inward of the point 44 recedes from a second line 45. The second line 45 is defined as containing said point 44 and being perpendicular to the first line 42, i.e., parallel to the direction of travel of the coin 40 when the slide 25 is maximally displaced. In the preferred embodiment shown in FIG. 4, the side 23 of the passageway comprises a narrow shoulder which rapidly recedes from the second line 45.

Similarly, desirably the portion of the slide 25 inward of said first point 43 recedes from a third line 46. The third line is defined as containing the first point 43 and being perpendicular to said first line 42. The coin-contacting portion of slide 25 preferably is generally curved convexly. Such a configuration facilitates the snap-action and is not subject to excessive wear. Desirably the radius of curvature of said portion is less than about 0.75 inches (about 20 mm), and preferably about 0.40 inches (about 10 mm).

To enhance discrimination between coins whose diameters vary only slightly, namely between the penny and dime, desirably the direction of displacement of the slide 25, as indicated by arrows 41, is not parallel to the first line 42. So long as this condition is met, the differences in the distance of displacement of the slide 25 will be larger than the differences in respective coin diameters.

FIG. 5 demonstrates schematically the geometrical relationship. For ease of explanation, the side of the passageway 23' across from the slide 25 is shown as a flat surface parallel to the direction of travel of the coin 40. If the slide 25' is oriented such that its direction of displacement 41' is parallel to the diameter 42 defined by the two points of contact 43 and 44, then the distance of displacement of the slide will be equal to the diameter of the coin 40 (assuming that in the at-rest position the slide is in contact with the opposing side 23). When the direction of displacement of the slide is not parallel to line 42, however, then the distance of displacement corresponds to the hypotenuse D, which must be greater than the diameter d of the coin 40. Stated another way, considering the triangle shown in FIG. 5, as long as x has a value, D will be larger than d; $x=0$ only when the direction of displacement of the slide 25' is parallel to the first line 42. Thus, the orientation of the slide 25 provides mechanical amplification of differences between coin diameters.

By way of example, in the preferred embodiment depicted in FIGS. 2–4, although the difference in diameter between a penny and a dime is only 1.1 mm, the difference in displacement of the slide 25 is approximately 1.8 mm. The larger distance of displacement allows the segments 28 of the contact surface to be larger and/or allows the wiper contact to be of larger dimension, thereby increasing durability and ease of manufacture.

Figure 7:
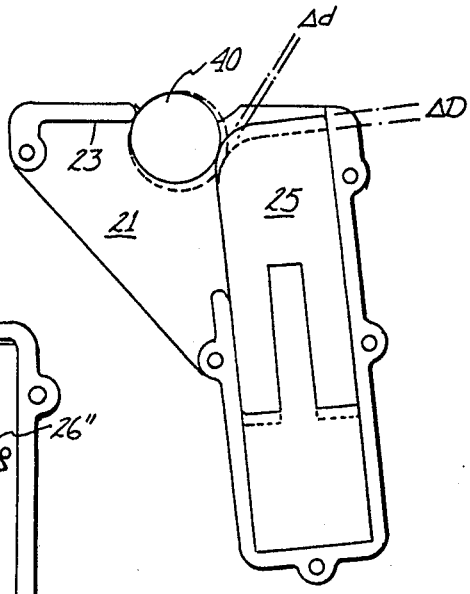
FIG. 7 is yet another broken away view of a coin discriminating apparatus of the invention.

FIG. 7 depicts graphically the mechanical amplification; $\Delta d$, the difference in diameters of two coins, is visibly smaller than $\Delta D$, the difference in displacement of the slide 25.

Figure 6:
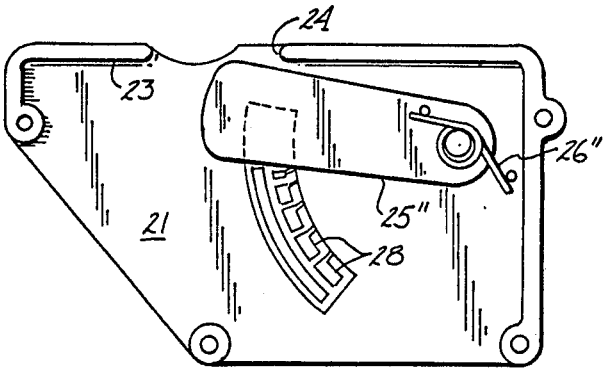
FIG. 6 is a broken away view of an alternative embodiment of the invention.

In the preferred embodiment depicted in FIGS. 2–4, the slide 25 is displaced linearly. The slide can be configured so as to move in other directions, however. As shown in FIG. 6, the slide 25'' comprises a pivoting arm loaded by a torsion spring 26''. As stated above, the only restriction on direction of movement of the slide is that it not move parallel to the line 42 defined by the two contact points of the coin 40 at maximum slide displacement. Referring again to FIG. 5, as long as $x \neq 0$, $\Delta D$ will be greater than $\Delta d$.

The various parts of the coin discriminating apparatus may be manufactured from any suitable materials; with the exception of electronic parts and the spring, the mechanism may be economically manufactured from suitable plastics. It is, of course, important that the surfaces of the slide 25 and the passageway side 23 contacted by coins be relatively smooth and reasonably resistant to wear, as undue wear may cause changes in the physical dimensions of the device which would affect its accuracy.

In operation, as a coin is deposited into the slot 11, the slide 25 will be displaced an amount related to the diameter (and therefore the denomination) of the coin 40. As the coin 40 passes the point of maximum slide 25 displacement, the spring pressure on the slide will urge the coin inwardly with a snap-action. Simultaneously with the displacement of the slide, the wiper contacts 27 move along the contact surface 28, which movement is detected electronically and converted to a signal sent to the display to indicate the denomination of the coin inserted. The display may indicate such other information as is desired, including the total amount deposited.

While a preferred embodiment of the present invention has been described, it should be understood that various changes, adaptations, and modifications may be made therein without departing from the spirit of the invention and the scope of the appended claims.

What is claimed is:

1. A coin discriminating apparatus for discriminating between coins of varying diameters, comprising:

a. a housing having coin slot means in a surface thereof for receiving therein a coin inserted into the housing, said slot means including two generally flat, spaced walls defining therebetween the width of a coin passageway, and two relatively narrow, spaced sides defining therebetween the breadth of the passageway;

b. a movable slide disposed within the passageway, and being normally biased toward a resting position at least partially obstructing the breadth of the passageway and being movable in response to insertion of a coin; and c. detection means operatively connected to said slide for detecting movement of the slide and relating said movement to coin diameter whereby when a coin is inserted through the passageway between the slide and a first of said sides the slide is displaced a distance related to the coin diameter, which displacement is detected by the detection means and related to the coin size.

2. The apparatus of claim 1 wherein the detection means includes a wiper switch mechanism comprising a contact surface and a movable wiper contact mechanically linked to the slide and in electrically conductive contact with the contact surface.

3. The apparatus of claim 2 wherein the contact surface includes a plurality of conductive segments, each corresponding to a particular coin size.

4. The apparatus of claim 1 further including display means associated with the housing and interconnected with the detection means for displaying the value of the coin being inserted.

5. The apparatus of claim 1 wherein the slide is movable in a direction not parallel to a first line defined by a first point of contact between a coin and the slide and a second point of contact between the coin and said first side of the passageway, said points of contact being identified when the slide is maximally displacd by the coin, whereby the differences in displacement of the slide upon insertion of coins of varying diameters will be larger than the differences in the respective coin diameters.

6. The apparatus of claim 2 wherein the breadth of the passageway increases immediately inwardly of said first line, providing a snap-action to thrust the coin inwardly.

7. The apparatus of claim 6 wherein that portion of the first side of the passageway inward of said second point recedes from a second line which contains said second point and is perpendicular to said first line.

8. The apparatus of claim 6 wherein that portion of the slide inward of said first point recedes from a third line which contains said first point and is perpendicular to said first line.

9. The apparatus of claim 6 wherein the surface of the slide contacted by the coins is curved convexly.

10. The apparatus of claim 9 wherein said curvature is defined by a radius of less than about 0.75 inches (about 20 mm).

11. The apparatus of claim 6 wherein that portion of the first side of the passageway containing said second point is curved convexly.

12. The apparatus of claim 6 wherein that portion of the first side of the passageway which is contacted by the coin when the slide is maximally displaced comprises generally a narrow shoulder.

13. An electronic toy bank having a coin discriminating apparatus for discriminating between coins of varying diameters, said mechanism including:

a. a housing having coin slot means in a surface thereof for receiving therein a coin inserted into the housing, said slot means including two generally flat, spaced walls defining therebetween the width of a coin passageway, and two relatively narrow spaced sides defining therebetween the breadth of the passageway;

b. a movable slide disposed within the passageway and being normally biased toward a resting position at least partially obstructing the breadth of the passageway and being movable in response to insertion of a coin, said movement being in a direction not parallel to a first line defined by a first point of contact between a coin and the slide and a second point of contact between the coin and said first side of the passageway, said points of contact being identified when the slide is maximally displaced by the coin; the breadth of the passageway increasing immediately inwardly of said first line, providing a snap-action to thrust the coin inwardly;

c. detection means operatively connected to said slide and detecting movement of the slide and relating said movement to coin diameter so that when a coin is inserted through the passageway between the slide and a first of said sides, the slide is displaced a distance related to the coin diameter, which displacement is detected by the detection means and related to the coin size;

d. the detection means including a wiper switch mechanism comprising a contact surface and a movable wiper contact mechanically linked to the slide and in electrically conductive contact with the contact surface, said surface including a plurality of conductive segments each corresponding to a particular coin size; and e. display means associated with the housing and interconnected with the detection means for displaying the value of the coin being inserted.

* * * * *